US008359795B2

(12) United States Patent
Béland

(10) Patent No.: US 8,359,795 B2
(45) Date of Patent: Jan. 29, 2013

(54) WINDOW CLADDING

(75) Inventor: Nadine Béland, Shannon (CA)

(73) Assignee: Dallaire Industries Ltd., Levis, Quebec (CA)

( * ) Notice: Subject to any disclaimer, the term of this patent is extended or adjusted under 35 U.S.C. 154(b) by 614 days.

(21) Appl. No.: 12/267,908

(22) Filed: Nov. 10, 2008

(65) Prior Publication Data

US 2009/0151277 A1 Jun. 18, 2009

Related U.S. Application Data

(60) Provisional application No. 60/986,673, filed on Nov. 9, 2007.

(51) Int. Cl.
*E06B 3/30* (2006.01)

(52) U.S. Cl. ..... 52/204.53; 52/717.01

(58) Field of Classification Search ..... 52/211, 52/204.53, 205.54, 717.01; 49/400, 501, 49/504

See application file for complete search history.

(56) References Cited

U.S. PATENT DOCUMENTS

| | | | | |
|---|---|---|---|---|
| 4,266,387 | A * | 5/1981 | Karlsson | 52/656.1 |
| 4,328,644 | A * | 5/1982 | Scott et al. | 49/501 |
| 4,420,919 | A | 12/1983 | Weber | |
| 4,982,530 | A * | 1/1991 | Palmer | 49/504 |
| 5,081,793 | A * | 1/1992 | Mauro | 49/501 |
| 5,473,851 | A * | 12/1995 | Northrup, Jr. | 52/513 |
| 5,515,652 | A * | 5/1996 | Klimek | 49/501 |
| 5,553,420 | A * | 9/1996 | Klimek | 49/501 |
| 5,560,149 | A | 10/1996 | Lafevre | |
| 5,575,115 | A | 11/1996 | Lindgren et al. | |
| 6,164,025 | A | 12/2000 | Lindgren | |
| 6,263,626 | B1 | 7/2001 | Gerhardt | |
| 6,427,397 | B1 * | 8/2002 | Kolaschnik | 52/204.5 |
| 6,745,523 | B2 | 6/2004 | Petta | |
| 6,964,290 | B2 * | 11/2005 | Woodward et al. | 160/92 |

FOREIGN PATENT DOCUMENTS

| | | | |
|---|---|---|---|
| DE | 3117139 | A1 * | 2/1982 |
| EA | 0000670 | B1 | 2/2000 |
| WO | 2005035928 | A1 | 4/2005 |

* cited by examiner

*Primary Examiner* — Christine T Cajilig

(74) *Attorney, Agent, or Firm* — Curtis B. Behmann; Borden Ladner Gervais LLP

(57) ABSTRACT

A window cladding assembly that fits on the inside of an awning or casement type window unit to cover from view the frame of the window unit and the perimeter of the window unit sash.

9 Claims, 8 Drawing Sheets

WINDOW CLADDING

CROSS REFERENCE TO RELATED APPLICATIONS

This application claims the benefit of priority of U.S. Provisional Patent Application No. 60/986,673 filed Nov. 9, 2007, which is incorporated herein by reference in its entirety.

FIELD OF THE INVENTION

The present invention relates generally to windows. More particularly, the present invention relates to cladding systems for windows.

BACKGROUND OF THE INVENTION

The majority of present day residential window units use lengths of extruded materials such as, for example, polyvinyl chloride (PVC) as framing for both the outer frame of the window unit as well as for the frame of the window sash. This is advantageous over classic wooden windows in that the extruded materials are cheaper to manufacture and are lighter and more durable than wood. There have been efforts to enhance the visual appeal of such extrusion-based windows as seen from the inside of a house to which the windows are fixed.

A number of solutions have been proposed to provide interior wood cladding to extrusion-based window units. In these cases, wood cladding parts are secured to the frame of the window unit to mask the extruded material of which the frame is made; separate wood cladding parts are secured to the sash of the window unit to mask the extruded material of which the sash is made.

Specific problems exist in relation to the sash of such window units. In existing window cladding systems, there is often a wood cladding part secured to the sash to act as a stop that secures a windowpane in the sash. Alternatively, there can be a wood cladding part secured to a glazing bead, usually made of an extruded material, which retains the windowpane in the sash.

One of the problems associated with such window cladding systems is that, for example, for casement and awning type window units, the wood parts secured to the sash become exposed to exterior weather conditions upon the window being open. Further, in cold weather conditions, the wood parts secured to the sash are subject to condensation trickling down the windowpane when high humidity levels are present inside the house. This is disadvantageous for a number of reasons. Firstly, exposure of parts of the window cladding system to exterior weather conditions and/or condensation can accelerate aging of those parts and therefore cause a color mismatch with parts of the window cladding system that are not exposed to the outside. Secondly, replacement of the windowpane, usually years after the window unit has been originally installed, requires the replacement of the window cladding part used to secure the windowpane to the sash. The odds of finding replacement window cladding parts that match the original cladding in color and grain are very low. Therefore, the replacement of a windowpane, and of its related wood cladding, is almost certain to skew the interior appearance of the window unit.

Another problem with existing extruded window systems having interior wood cladding is that either the frame of the window, the perimeter of the sash, or both, require special profiling to inter-fit with the window cladding parts. This implies that a manufacturer of windows must have an assembly/extrusion line dedicated to these interiorly clad windows. If the manufacturer also wishes to sell lower-end windows that do not have the wood cladding option, another assembly/extrusion line is required. An additional problem with existing window systems to which interior cladding can be installed is that they usually require adapter parts to be mounted on the window unit before the cladding itself can be installed. This means that the manufacturer/installer must carry these adapter parts in inventory. Yet another problem is that existing interior cladding assemblies for windows fail to conceal completely the frame of the window, the perimeter of the sash, and the glazing bead retaining the windowpane.

Therefore, it is desirable to provide a wooden window cladding assembly that covers or masks the interior side of a window unit made of extruded materials without exposing any part of the cladding assembly to exterior weather conditions upon the window being open. Further, it is desirable to provide a wooden window cladding assembly that can be retrofitted to the interior side of a window unit without requiring any special mating features on either the window unit or the cladding assembly.

SUMMARY OF THE INVENTION

It is an object of the present invention to obviate or mitigate at least one disadvantage of previous window cladding systems.

In a first aspect, the present invention provides a cladding assembly for a window unit having a frame and a sash pivotally secured to the frame. The sash has a windowpane set therein. The frame has a first interior surface and the sash has a second interior surface. The first interior surface and the second interior surface are located inside a building to which the window unit is to be secured. The cladding assembly comprises a frame covering part masking from view, when installed, the first interior surface. The cladding assembly also comprises a sash covering part to secure to a securing framework to mask from view the second interior surface when the window unit is closed. The sash covering part extends away from the securing framework towards the windowpane when the window unit is closed. The securing framework comprises the frame covering part and/or the frame.

The cladding assembly can have a glazing bead that secures the windowpane to the sash and the sash covering part masks from view the glazing bead when the window unit is closed. The sash covering part and the windowpane define a gap therebetween when the window unit is closed. The gap has a minimum value substantially at a portion of the sash covering part that is farthest away from the securing framework to which the sash covering part is secured. The glazing bead can be inside or outside the building to which the window unit is secured. When the glazing bead in inside the building, the frame covering part can overhang the glazing bead to mask the glazing bead from view. The frame covering part and/or the sash covering part can be made of a wood product. The frame covering part and/or the sash covering part can be made of a synthetic material. The synthetic material can includes aluminum, polyvinyl chloride (PVC), cellular PVC, acrylonitrile butadiene styrene, GELOY™, fiberglass, acrylic, acrylonitrile styrene acrylate and/or plastic. The frame covering part and/or the sash covering part can be made by extrusion. The cladding assembly can further comprise a snap-fit, an adhesive and/or fasteners to secure the frame covering part to the frame, and to secure the sash covering part to the securing framework. The fasteners can include a screw, and a nail, a micro-pin and/or a staple. The frame and the sash can be made of extruded synthetic materials. The cladding assembly can further comprising a jamb and/or a junction member to secure to the frame. The junction member is to be secured to the window unit between the jamb and the frame covering part. The frame covering part, in the installed position, is secured the frame, the jamb and/or the junction member. As is known in the art, GELOY™ is a blend of Acrylonitrile Styrene Acrylate and Acrylonitrile butadiene styrene.

In a second aspect, the present invention provides a cladding assembly for a window unit that has a frame and a sash pivotally secured to the frame. The sash has a windowpane set therein. The frame has a first interior surface and the sash has a second interior surface. The first interior surface and the second interior surface are located inside a building to which the window unit is to be secured upon the window unit being closed. The cladding assembly comprises a frame covering subassembly that masks from view, in an installed position, the first interior surface. The subassembly includes a frame covering part and/or a jamb. The cladding assembly also comprises a sash covering part to secure to a securing framework to mask from view the second interior surface when the window unit is closed. The sash covering part extends away from the securing framework towards the windowpane when the window unit is closed. The securing framework comprises the frame covering subassembly and/or the frame.

The frame covering subassembly can include a junction member disposed between the frame covering part and the jamb. The cladding assembly can further comprise a first fastener to fasten the jamb and the junction member to the frame and a second fastener to secure the frame covering part and the sash covering part to the frame. The window unit can be a casement window unit or an awning window unit.

In a third aspect, the present invention provides a cladding assembly for a window unit. The window unit has a frame and a windowpane fixedly secured to the frame with a glazing bead. The frame has an interior surface located inside a building to which the window unit is to be secured. The cladding assembly comprising a jamb and/or a junction member to secure to the frame. The cladding assembly further comprises a glazing bead covering part to secure to a securing framework. The glazing bead covering part extends away from the securing framework towards the windowpane. The glazing bead covering part masks from view the interior surface and the glazing bead. The junction member is to be disposed between the jamb and the glazing bead covering part. The securing framework comprises the frame and/or the jamb and/or the junction member.

The glazing bead can include a glazing bead segment extending horizontally along a bottom portion of the windowpane on the inside of the building. The cladding assembly can further comprise a wall formed between the glazing bead segment and the glazing bead covering part. The wall is to present pooling of condensation on the glazing bead covering part.

In a fourth aspect, the present invention provides a cladding assembly for a window unit having a frame and a sash pivotally secured to the frame. The sash has a windowpane set therein. The frame has a first interior surface and the sash has a second interior surface. The first interior surface and the second interior surface are located inside a building to which the window unit is to be secured. The cladding assembly comprises an integral covering part installed on the window unit to the frame. The integral covering part has a frame covering portion masking from view, in an installed position, the first interior surface. The integral covering part also has a sash covering portion to mask from view the second interior surface when the window unit is closed. The sash covering portion extends away from the frame covering portion towards the windowpane when the window unit is closed.

In a fifth aspect, the present invention provides a window unit. The window unit comprises a frame and a sash pivotally secured to the frame. The sash has a windowpane set therein. The frame has a first interior surface and the sash has a second interior surface. The first interior surface and the second interior surface, when the window unit is closed, are located inside a building to which the window unit is to be secured. The window unit further comprises a frame covering part secured to the frame. The frame covering part masks from view the first interior surface. The window unit further comprises a sash covering part secured to a securing framework. The sash covering part extends away from the securing framework towards the windowpane. The sash covering part masks from view the second interior surface when the window unit is closed. The securing framework comprises the frame covering part and/or the frame.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a window cladding assembly that fits on the inside of an awning or casement type window unit to cover from view the frame of the window unit and the perimeter, including the glazing bead, of the window unit sash. The window cladding assembly can be retrofitted to existing window units. All the parts of the window cladding assembly remain on the inside of the building to which the window unit is attached, whether or not the window unit is open. This precludes differential aging of the window cladding parts.

Figure 1:
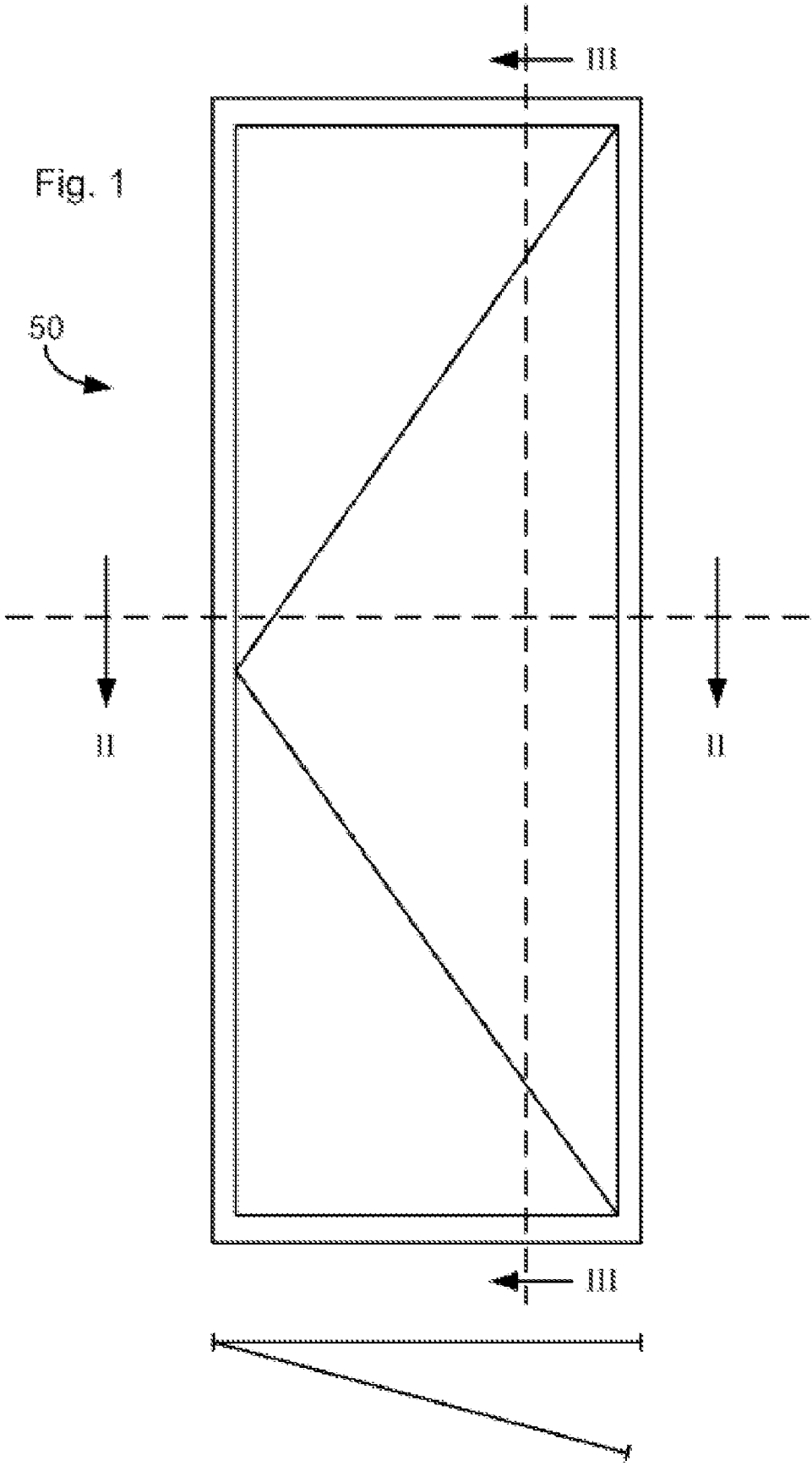
FIG. 1 shows a front exterior of a casement window unit to which embodiments of the cladding assembly of the present invention can be installed.

FIG. 1 shows a front view, as seen from the outside, of a casement window unit 50 that can be fitted with a window cladding assembly or system of the present invention. An embodiment of a window cladding assembly 52 of the present invention is shown in detail at FIGS. 2A and 3 where respective horizontal and vertical cross-sectional views of the window unit 50 are shown. The cladding assembly 52 includes a frame covering part 54 that can be secured to the frame 56 of the window unit 50 through any suitable means such as, for example, fasteners (e.g., screws, micro-pins, staples etc.), clips, snap fits, and/or adhesives (not shown). The cladding assembly 52 further includes a sash covering part 58 secured to the frame covering part 54 and to the frame 56 by a fastener 60, shown as a screw. As will be understood by the skilled worker, any other suitable type of fastener can be used. The sash covering part 58 can alternatively be secured only to the frame 56 or only to the frame covering part 54. The frame covering part 54 masks from view a first interior surface 62 of the frame 56 while the sash covering part 58 masks from view a second interior surface 64 of the sash 66 in which is set a windowpane 68. As will be understood by the skilled worker, the frame covering part 54 and the sash covering part 58 can be integrated into a single integral covering part (not shown). In this case the integral covering part would have a frame covering portion functioning substantially as the frame covering part 54 and a sash covering portion. functioning substantially as the sash covering part 58.

The sash covering part 58 extends away from the frame covering part 54 towards the windowpane 68, which is secured to the sash 66 by a glazing bead 70. The sash covering part 58 and the windowpane 68 define a gap therebetween, and the sash covering part 58 overhangs the glazing bead 70, which in disposed within the gap 72. As such, the sash covering part 58 also masks from view the glazing bead 70. The sash covering part 58 can extend towards the windowpane 68 in a generally oblique direction, i.e., in a direction that is neither parallel nor perpendicular to the windowpane 68.

Figure 2A:
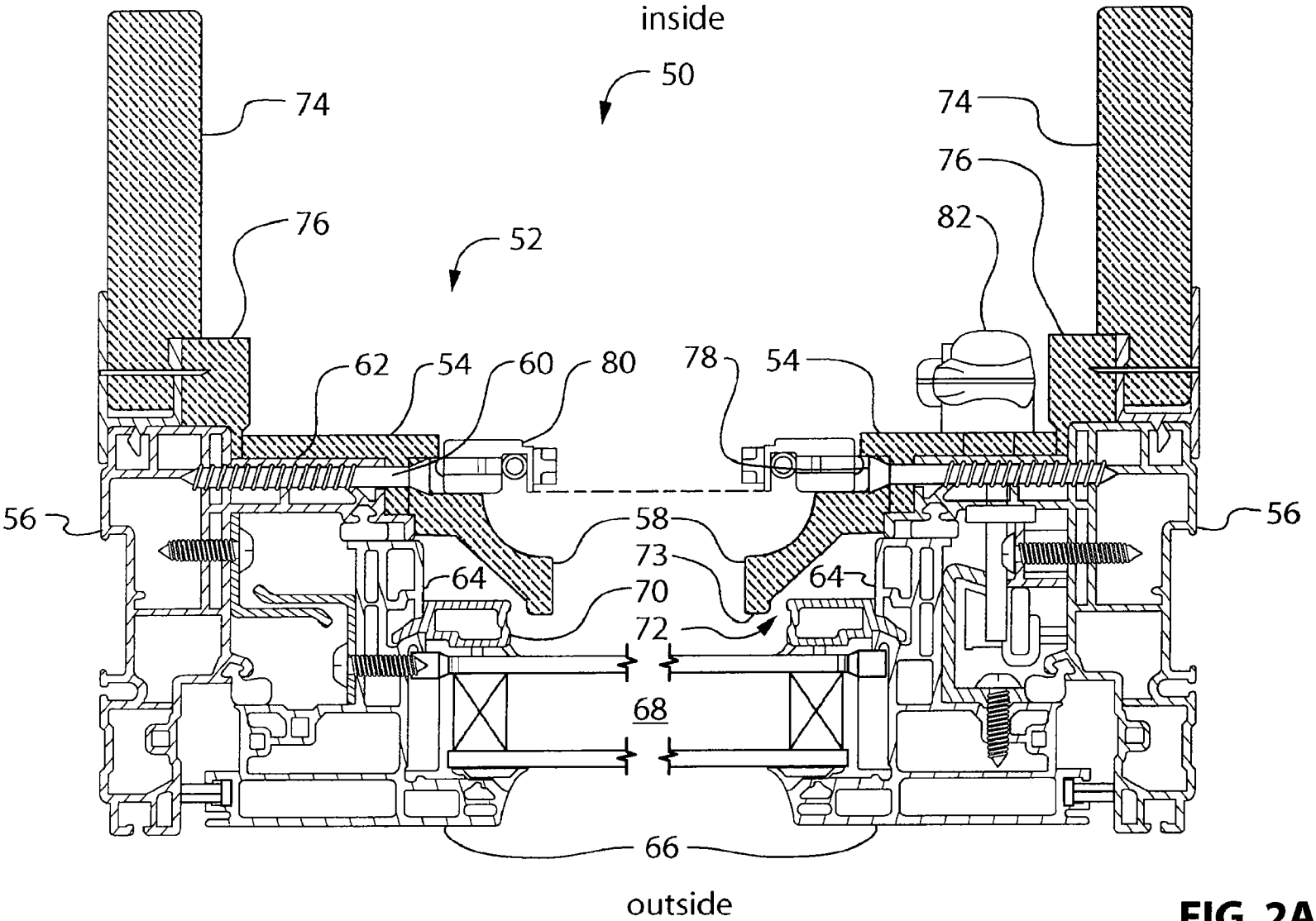
FIG. 2A shows a horizontal cross-sectional view taken along the line II-II of the window unit of FIG. 1 fitted with an embodiment of the window cladding assembly of the present invention.

As will be understood by the skilled worker, the glazing bead 70, instead of being, as shown at FIG. 2A, on the inside of the building to which the window unit is secured, can be on the outside of the building in question without departing from the scope of the present invention.

Figure 3:
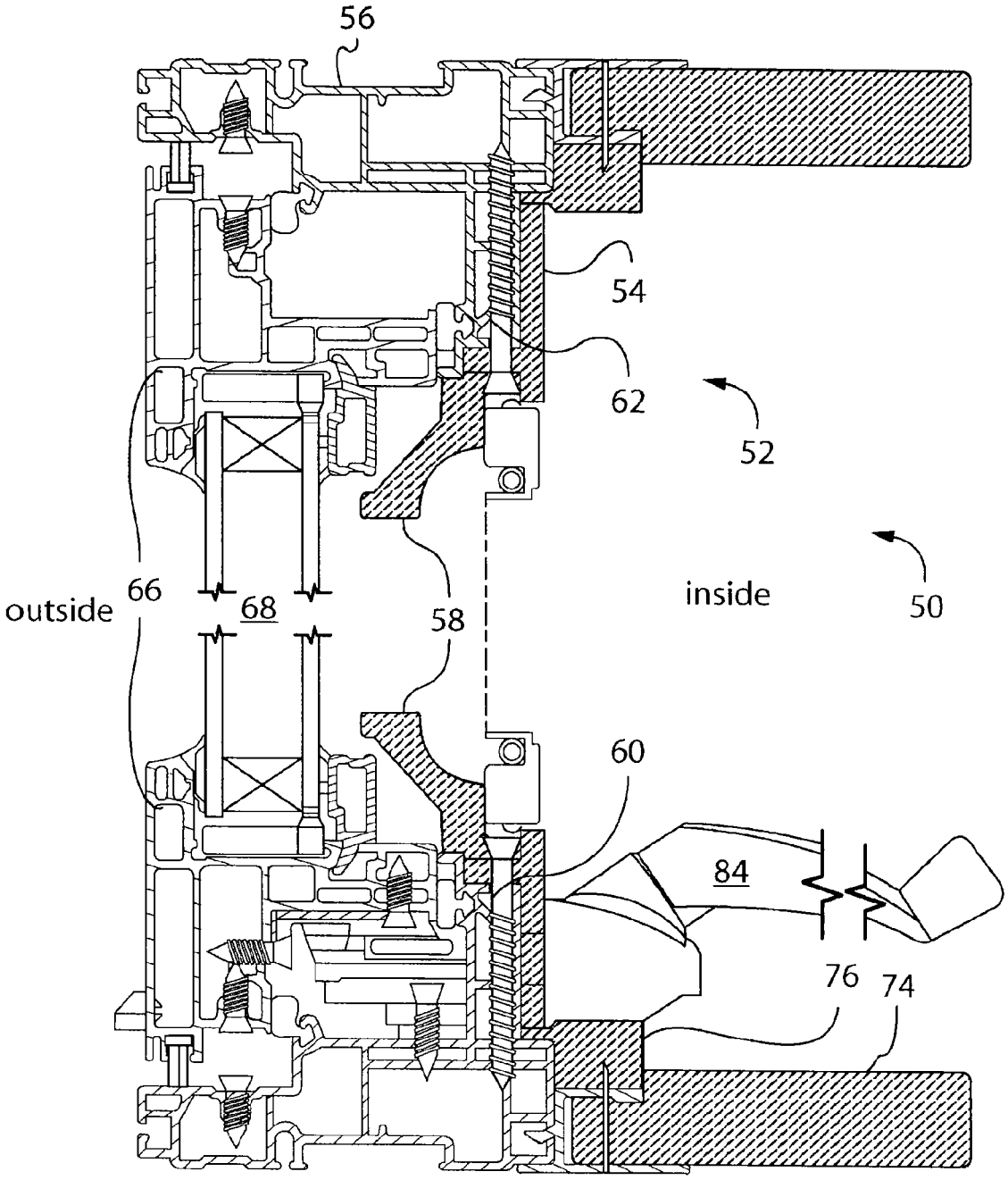
FIG. 3 shows a vertical cross-sectional view taken along the line III-III of the window unit of FIG. 1 fitted with an embodiment of the window cladding assembly of the present invention.

Thus, part of the frame 56, the sash 66 and the glazing bead 70 are hidden (masked) from view, from the inside of the building to which the window unit 50 is secured, when the window unit 50 is closed. The window unit 50 can also be fitted with a jamb 74 and a junction member 76 to complete the inside covering of the frame 56 of the window unit 50. As will be understood by the skilled worker, the frame covering part 54 can be profiled, as a single piece, to cover, in addition to the first interior surface 54, the parts of the frame 56 that are shown at FIGS. 2A and 3 as being covered by the junction member 76 and the jamb 74, without departing from the scope of the present invention. As will be understood by the skilled worker, the jamb 74 and the junction member 76 can be used with or without the sash covering part 54 in cases where the interior appearance of the window unit 50 is not of concern. As will be understood by the skilled worker, the frame covering part 54, instead of, or in addition to, being secured to the frame 56, can be secured to the jamb 74 and/or the junction member 76 without departing from the scope of the present invention.

The gap 72 between the windowpane 68 and the sash covering part 58 allows for any water condensation occurring on the windowpane 68 to slide down to the glazing bead 70 without substantially coming in contact with, or accumulating on, the sash covering part 58. Any condensation accumulated in the vicinity of the glazing bead 70 can then evaporate out of view. This feature is advantageous in that the absence of condensation on the sash covering part 58 prolongs the lifetime of the part in question and precludes changes in appearance of the sash covering part 58 with respect to the frame covering part 54. The gap 72 can have a minimum width value at a portion 73 of the sash covering part 58 that is farthest away from the frame covering part 54 to which the sash covering part is secured.

Figure 2B:
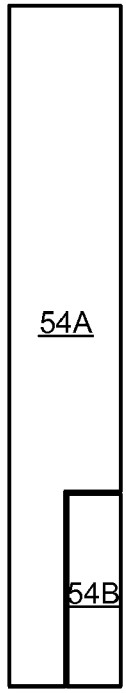
FIG. 2B shows a side view of profiled, inter-fitting, horizontal and vertical frame covering parts.
Figure 2C:
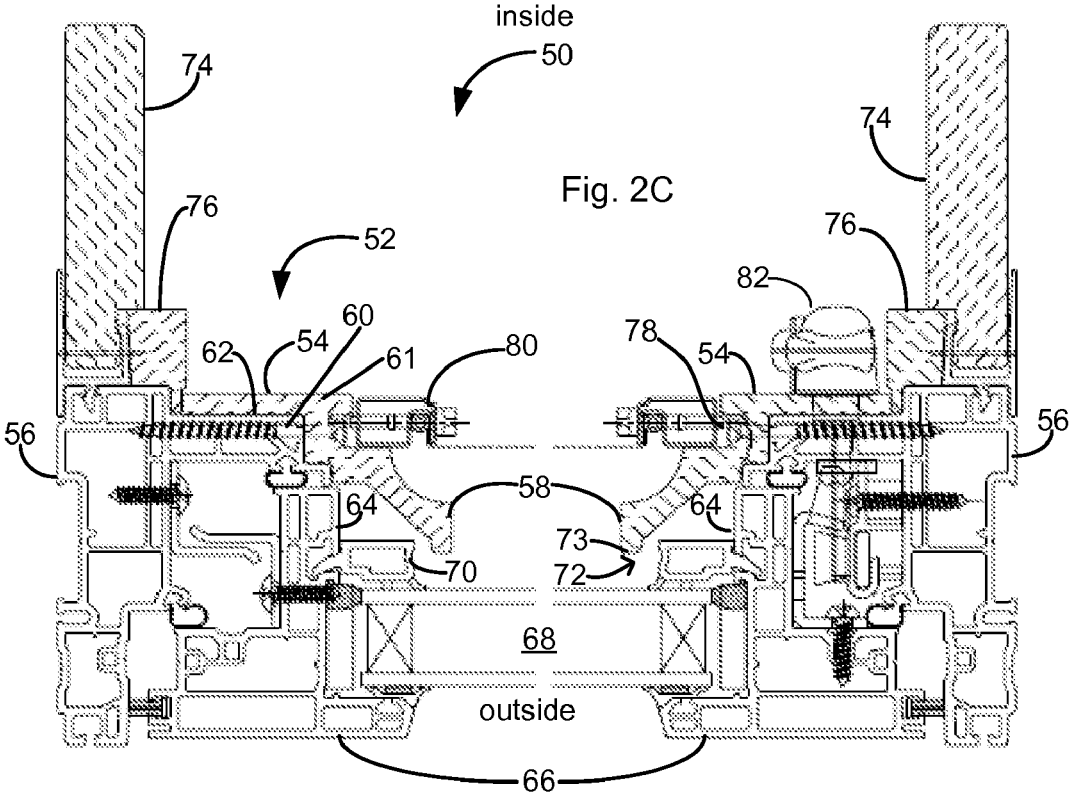
FIG. 2C shows a horizontal cross-sectional view of a window unit similar to that of FIG. 1, but with an integral covering part.

As seen at FIG. 2A, the frame covering part 54 and sash covering part 58 form a channel 78 which can serve to anchor a removable screen assembly 80 to the window unit 50. FIG. 2A also shows a lock assembly 82 used to lock the window unit 50 shut. Further, as seen at FIG. 3, the window unit 50 can be equipped with any suitable type of sash actuating mechanism 84. As will be apparent to the skilled worker, the frame covering part 54 can be machined or modified in any suitable way to provide passages to the lock assembly 82 and to the sash actuating mechanism 84, or to any other type of hardware of the window unit 50. Further, the skilled worker will understand that the miter joint (not shown) between the vertical and horizontal sash covering parts 58 and the frame covering parts 54 can be at any angle, including a 45° angle and a 90° angle. Further, as will be understood by the skilled worker, the vertical and horizontal frame covering parts 54 can be profiled to overlap each other at the corners of the frame. An example of such profiling is shown at FIG. 2B where a side view of a profiled vertical frame covering part 54A overlaps a profiled vertical frame covering part 54B. As will be understood by the skilled worker, similar overlapping can also be effected on vertical and horizontal sash covering parts. FIG. 2C shows an alternative embodiment where the frame covering part 54 and the sash covering part 58 form an integral covering part 61.

Figure 4:
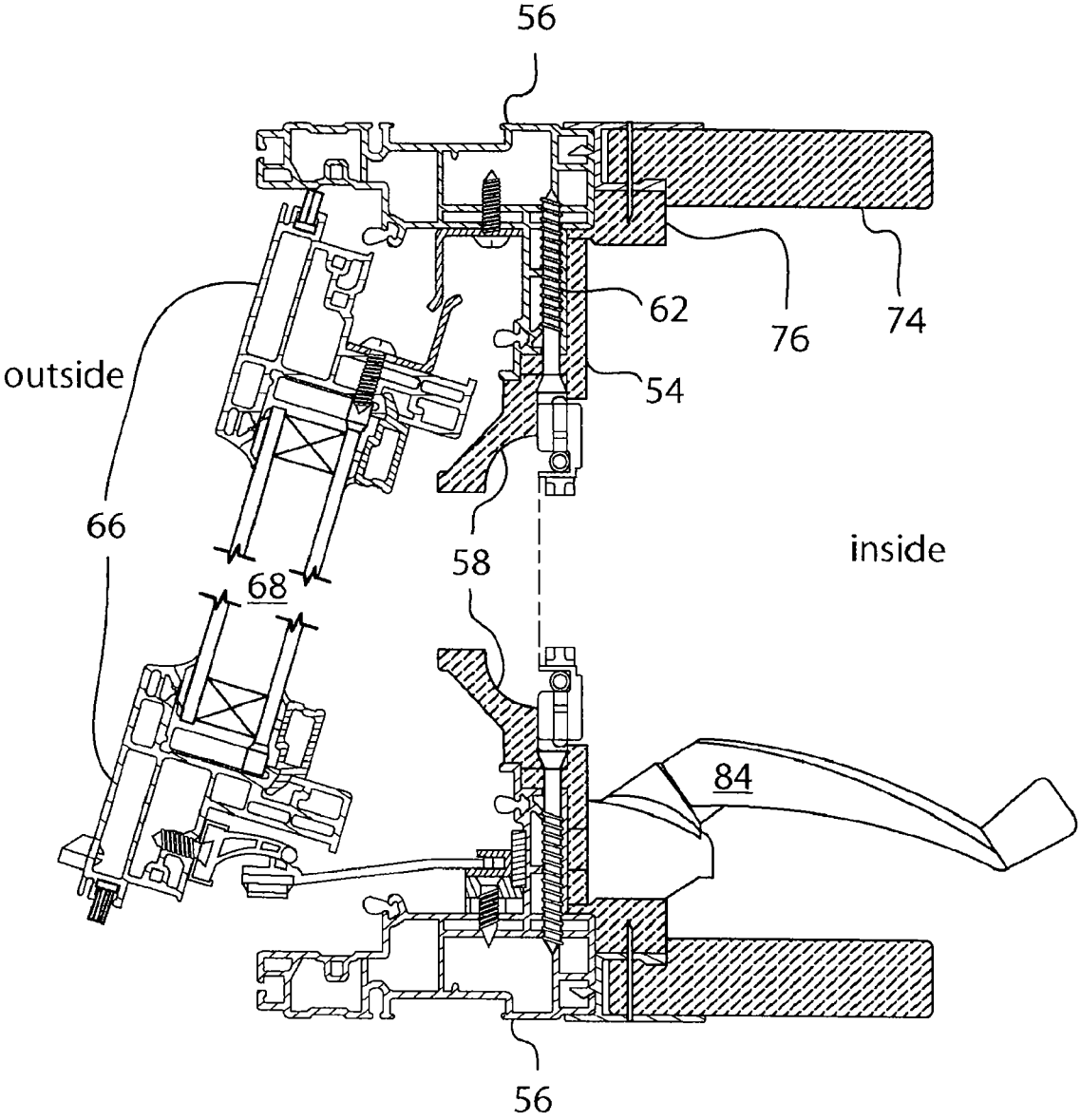
FIG. 4 shows a vertical cross-sectional view of an awning window unit in the open position and fitted with an embodiment of the window cladding assembly of the present invention.

FIG. 4 shows a vertical cross-sectional view of an awning window unit in an open position. Clearly, the frame covering part 54 and the sash covering part 58 remain inside while the sash 66 swings to the outside.

As will be understood by the skilled worker, the window cladding assembly 52 can be made of wood, or of any other suitable materials such as aluminum, polyvinyl chloride, acrylonitrile butadiene styrene, GELOY™, fiberglass, acrylic, acrylonitrile styrene acrylate plastic or any other suitable material. As stated above, GELOY™ is a blend of Acrylonitrile Styrene Acrylate and Acrylonitrile butadiene styrene. Further, the frame covering part 54 and the sash covering part 58 can have any suitable type of finish such as, for example, a metallic finish, a painted finish, a stained finish, a laminated finish etc., and be retrofitted to existing window units. An example of such a material is that of an extruded material that has been treated to have a finish having the appearance of wood. Further still, the skilled worker will understand that a single piece window cladding, functioning substantially as the frame covering part 54 cooperating with the sash covering part 58, is within the scope of the present invention.

As will be appreciated by the skilled worker, the exemplary window cladding assembly 52 allows for the windowpane 68 of the window unit 50 to be changed without having to remove and/or replace any part of the cladding assembly 52. Further, the skilled worker will appreciate that the window cladding assembly of the present invention, in addition to being applicable to window units having a moveable sash, is also applicable to window units having fixed sashes and window units having fixed windows. As will be understood by the skilled worker, a window unit with a fixed sash is similar to the window unit 50 shown at FIGS. 2A and 3 except that the sash is fixedly secured to the frame through any suitable means and that there are no locking or actuating mechanism.

Figure 5:
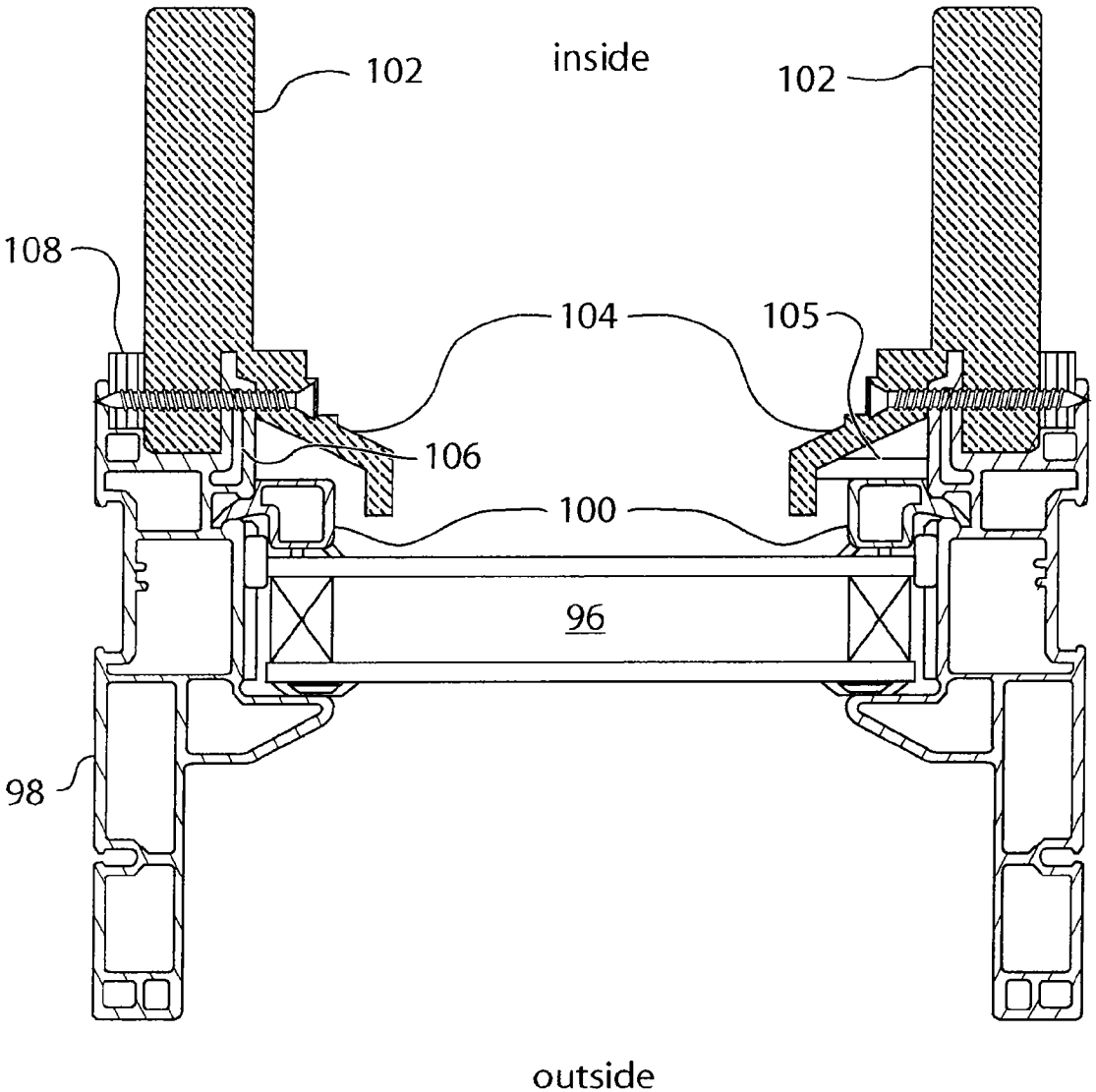
FIG. 5 shows a cross-sectional view of a fixed window unit fitted with an embodiment of the window cladding assembly of the present invention.

FIG. 5 shows a vertical cross-section of a window unit having a windowpane 96 secured to a frame 98 by glazing beads 100. In this case, the frame 98 and the glazing beads 100 are masked from view by a jamb 102 and by a glazing bead covering part 104 that also masks from view a portion 106 of the frame 98. As will be understood by the skilled worker, shims 108 can be used in fixing the jamb 102 to the frame 98. In window units having a fixed sash or a windowpane secured to the frame of the window (FIG. 5), replacing the windowpane involves removing the cladding assembly from the window unit (e.g., the glazing bead covering part 104 of FIG. 5); however, the same cladding assembly can be reused once the windowpane in question has been changed, thereby eliminating all concerns regarding finding matching sash cladding parts and frame covering parts. FIG. 5 also shows a retaining wall 105 that can be fitted between the bottom glazing bead 100, which is a bottom horizontal glazing bead segment, and the bottom glazing bead covering part 104. The function of this retention wall 105 is that, in prolonged high humidity conditions in which condensation is always forming on the windowpane 96, the retention wall 105 prevents pooling of water at the bottom glazing bead covering part 104. This is particularly advantageous when the glazing bead in question is made of wood. The retention wall can be made of any suitable material such as, for example, PVC. As will be understood by the skilled worker, window units with fixed windowpanes, such as shown at FIG. 5, can also have a junction member (not shown) disposed between the jamb 102 and the glazing bead covering part 104.

Figure 6:
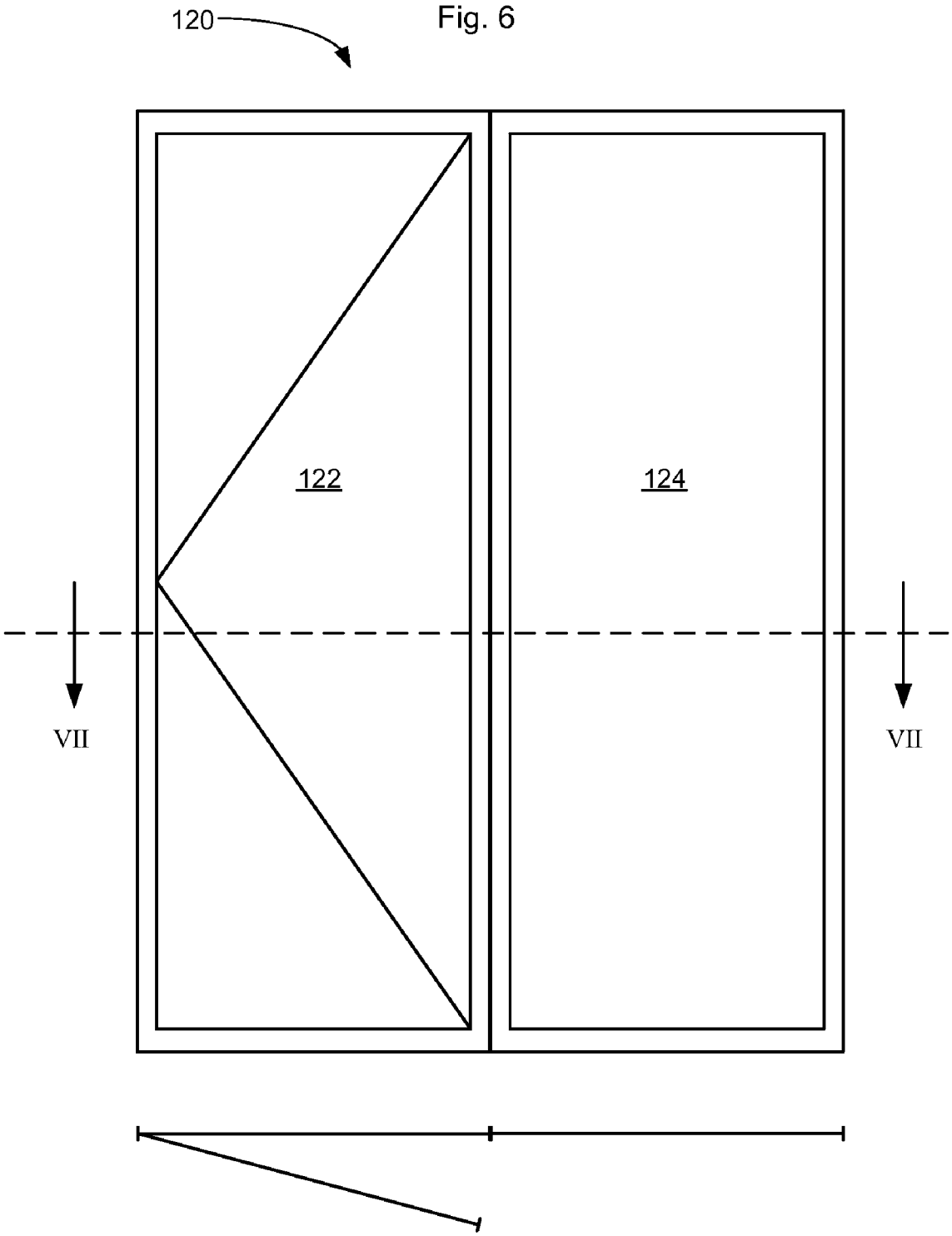
FIG. 6 shows a front exterior of a modular window unit comprising a casement window and a fixed window, to which embodiments of the cladding assembly of the present invention can be installed.
Figure 7:
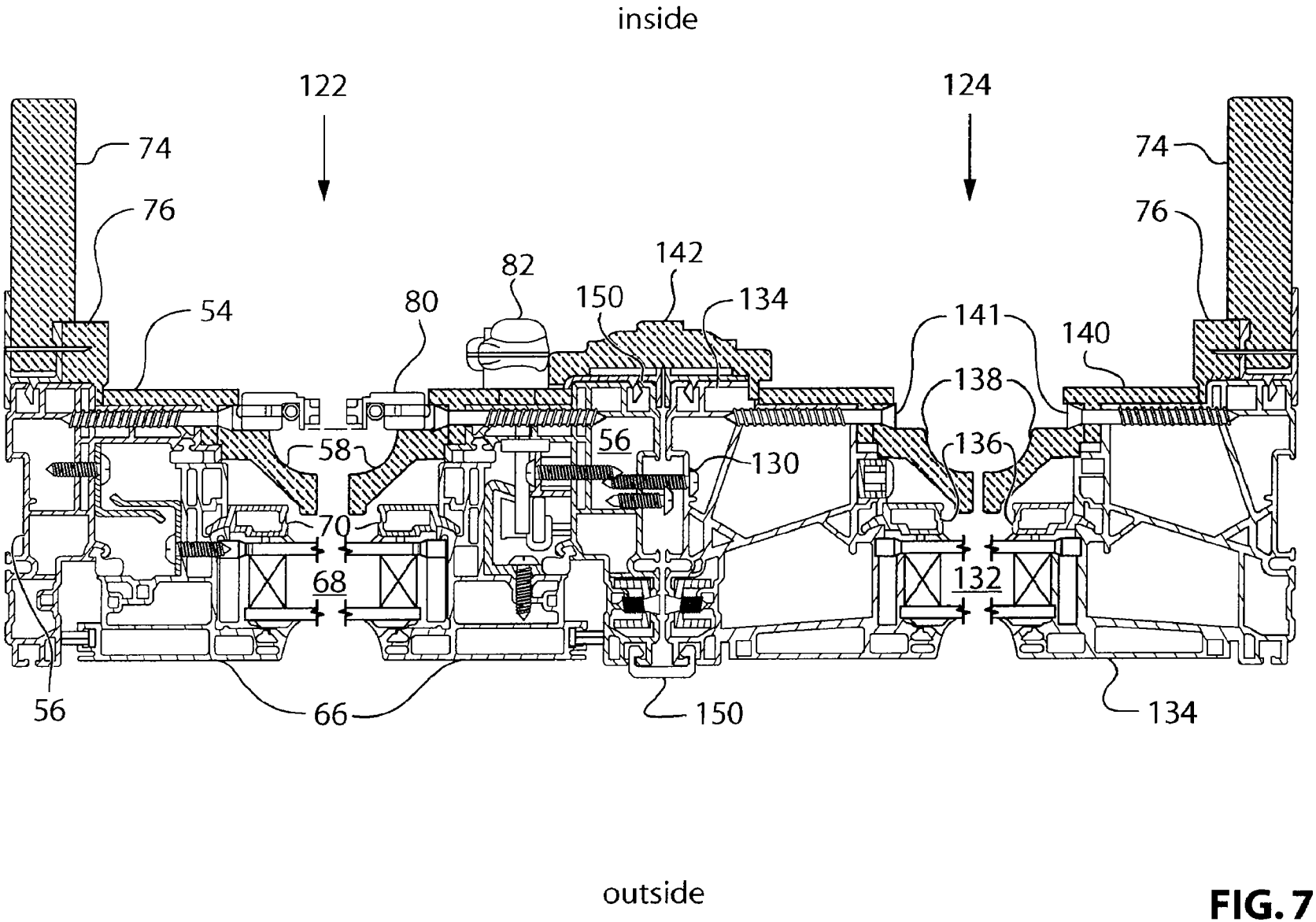
FIG. 7 shows a horizontal cross-sectional view of the window unit of FIG. 6 fitted with an embodiment of the window cladding assembly of the present invention.

FIG. 6 shows a front exterior view of a modular window unit 120 with which the window cladding assembly of the present invention can be used. The window unit 120 has a casement window section 122 and a fixed window section 124. FIG. 7 shows a horizontal cross-section view of the window unit 120. The casement window section 122 is similar to the window unit 50 shown at FIG. 2A and includes a frame 56, a sash 66, a cladding assembly having a frame covering part 54, a sash covering part 58 as well as a jamb 74 and a junction member 76. The casement window section 122 also includes glazing beads 70 securing a windowpane 68 to the sash 66. A screen assembly 80 and a lock assembly 82 are also part of the casement window section 122.

The fixed window section 124 in FIG. 7 is secured to the casement window section 122 by a fastener assembly 130, shown as a screw assembly. As will be understood by the skilled worker, the fixed window section 125 can be additionally, or alternatively, secured to the casement window section 122 by any other suitable means such as, for example, snap-fit caps 150 and adhesives. The fixed window section 124 has a windowpane 132 secured to a frame 134 by glazing beads 136, which are masked from view by glazing bead covering parts 138, which can be similar to the sash covering parts 58. The fixed window section 124 also includes frame covering parts 140, which can be similar to the frame covering parts 54. The glazing bead covering part 138 is shown secured to the frame covering part 140 and to the frame 134 by screws 141. A jamb 74 and a junction member 76 are also part of the fixed window section 124. In addition to the various sash covering parts 58, glazing bead covering parts 138, frame covering parts 54 and 140, jambs 74 and junction members 76, the modular window unit 120 also includes a compound frame cover part 142 that masks from view the frame 56 and the frame 134 at the area where they are joined together by the screw assembly 130.

As will be understood by the skilled worker, even though the window units shown at FIGS. 2A, 3, 4, 5 and 7 have their respective glazing beads located inside the building to which they are respectively secured, the glazing beads could just as well be located on the outside of the building without departing from the scope of the present invention.

Therefore, the present invention provides a window cladding assembly that fits on the inside of an awning or casement type window unit to cover from view the frame of the window unit and the perimeter of the window unit sash. The window cladding assembly can be retrofitted to existing window units. All the parts of the window cladding assembly remain on the inside of the building to which the window unit is attached, whether or not the sash of the window unit is open. This precludes differential aging of the window cladding parts.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A window unit comprising:

a frame having a frame interior surface;

a sash pivotally secured to the frame, the sash having a sash interior surface that spans the perimeter of the sash;

a glazing bead;

a windowpane, the glazing bead securing the windowpane to the sash; and a cladding assembly having a frame covering part and a sash covering part, the frame covering part masking from view the frame interior surface, the sash covering part masking from view, when the window unit is closed, the sash interior surface that spans the perimeter of the sash, and the glazing bead, the sash covering part secured to a securing framework, the sash covering part, along the entire perimeter of the sash, extending away from the securing framework, at an oblique angle, towards the windowpane when the window unit is closed, the sash covering part overhanging the glazing bead when the window unit is closed, the securing framework comprising at least one of the frame covering part and the frame.

2. The window unit of claim 1 wherein the sash covering part and the windowpane define a gap therebetween when the window unit is closed, the gap having a minimum value substantially at a portion of the sash covering part being farthest away from the securing framework to which the sash covering part is secured.

3. The window unit of claim 1 wherein at least one of the frame covering part and the sash covering part are made of a wood product.

4. The window unit of claim 1 wherein at least one of the frame covering part and the sash covering part are made of a synthetic material.

5. The window unit of claim 4 wherein the synthetic material includes at least one of aluminum, polyvinyl chloride (PVC), cellular PVC, acrylonitrile butadiene styrene, fiberglass, acrylic, acrylonitrile styrene acrylate and plastic.

6. The window unit of claim 4 wherein at least one of the frame covering part and the sash covering part is made by extrusion.

7. The window unit of claim 1 wherein at least one of an adhesive and fasteners secure the frame covering part to the frame, and the sash covering part to the securing framework.

8. The window unit of claim 7 wherein the fasteners include a screw.

9. A window unit comprising:

a frame having a frame interior surface;

a sash pivotally secured to the frame, the sash having a sash interior surface that spans the perimeter of the sash;

a glazing bead;

a window pane, the glazing bead securing the window pane to the sash; and a cladding assembly having an integral covering part to secure to at least the frame, the integral covering part having a frame covering portion and a sash covering portion, the frame covering portion masking from view the frame interior surface, the sash covering portion masking from view, when the window unit is closed the sash interior surface that spans the perimeter of the sash, and the glazing bead, the sash covering portion extending away from the frame covering portion, and over the glazing bead, at an oblique angle, towards the windowpane when the window unit is closed, the sash covering portion overhanging the glazing bead.

* * * * *